United States Patent [19]

Sitzberger

[11] 3,994,225

[45] Nov. 30, 1976

[54] METHOD OF PRODUCING PERSONALIZED BADGES AND THE LIKE

[75] Inventor: Francis D. Sitzberger, Downers Grove, Ill.

[73] Assignee: Adcraft Mfg. Co., Chicago, Ill.

[22] Filed: Nov. 26, 1975

[21] Appl. No.: 635,284

Related U.S. Application Data

[63] Continuation of Ser. No. 446,238, Feb. 27, 1974, abandoned.

[52] U.S. Cl. ..... 101/426; 40/2.2; 101/369; 101/90; 346/33 R; 346/153; 96/27 R

[51] Int. Cl.[2] ..... B41M 3/00; B41L 45/12

[58] Field of Search ..... 101/426, 369

[56] References Cited

UNITED STATES PATENTS

| | | | |
|---|---|---|---|
| 3,152,901 | 10/1964 | Johnson | 96/43 |
| 3,191,154 | 6/1965 | Sallach et al. | 340/172.5 |
| 3,402,488 | 9/1968 | Leavitt | 40/2.2 |
| 3,619,573 | 11/1971 | Philip | 355/40 |
| R27,809 | 11/1973 | Drillick | 101/18 |

*Primary Examiner*—Clyde I. Coughenour
*Attorney, Agent, or Firm*—Hill, Gross, Simpson, Van Santen, Steadman, Chiara & Simpson

[57] ABSTRACT

A method of fabricating a plurality of individual badges such as name badges and the like, each bearing indicial material common to all of such plurality of badges, and each bearing specific indicial material exclusive to the respective individual badges, in which the badge blanks are initially imprinted with the common indicial material and subsequently provided with the respective exclusive indicial material by an electrostatic or photocopying process.

3 Claims, 4 Drawing Figures

METHOD OF PRODUCING PERSONALIZED BADGES AND THE LIKE

This is a continuation of application Ser. No. 446,238, filed Feb. 27, 1974, now abandoned.

BACKGROUND OF THE INVENTION

The invention is directed to the production of personalized badges, i.e., badges which contain indicial material common to all of the badges and in addition individual or specific indicial material which is different for each badge, i.e., normally is exclusive to a single badge.

Examples of this type of badge are those for use at conventions, shows, etc. wherein each delegate or member is provided with a badge containing, in addition to material identifying both the show or convention, other personal identification such as the name of the badge holder, the organization with which he is associated, location, address, etc. It will be appreciated that with such type of badge the inclusion of specific material, exclusive to each respective badge, presents problems in the printing thereof and where a large number of badges are involved, necessitates a considerable amount of time in effecting type changes, etc. if the badges are to be printed, likewise increasing the cost thereof.

The present invention is directed to a method of producing such badges in a simple, inexpensive and yet highly efficient manner, with the individual badges having an appearance equivalent to that achieved by the usual printing operation.

BRIEF SUMMARY OF THE INVENTION

The desired results are achieved with the present invention by a method in which a suitable sheet of badge stock is imprinted in the usual manner with material which is common to all badges, for example, name of the organization involved, class identification, i.e., guest, member, delegate, etc. which is applicable to all or a large number of the badges to be produced. Likewise, the back of such badge blank may be suitably imprinted with any desired informative material or the like, as for example location, dates, time, etc.

A master copy containing the individual specific indicial material to appear exclusively on respective badges is produced, with the specific material oriented in identical manner to the orientation and disposition of the respective individual badges imprinted on the sheet of badge stock. Such individual material may then be applied to the sheet of badge blanks by a photocopying operation in which such master sheet is utilized as the original to be duplicated and the sheet of badge blanks comprises the stock on which such duplication is to be effected. By suitable orientation of the common material appearing on the sheet of badge stock, duplication may be effected with proper orientation and registration with the common material, initially applied to the sheet, to complete the material to appear thereon. Following such operation the respective badges may be individually detached from the sheet and if desired placed in suitable holders.

To facilitate an ultimate separation of the respective badges the sheet of badge stock may be perforated, at a convenient time, along the marginal portions of each individual badge, enabling, if desired, the badges to be handled and transported in convenient sheet form and subsequently separated into the individual badges, for example, at time of use.

BRIEF DESCRIPTION OF THE DRAWINGS

In the drawings wherein like reference characters indicate like or corresponding parts:-

DETAILED DESCRIPTION OF THE INVENTION

Figure 1:
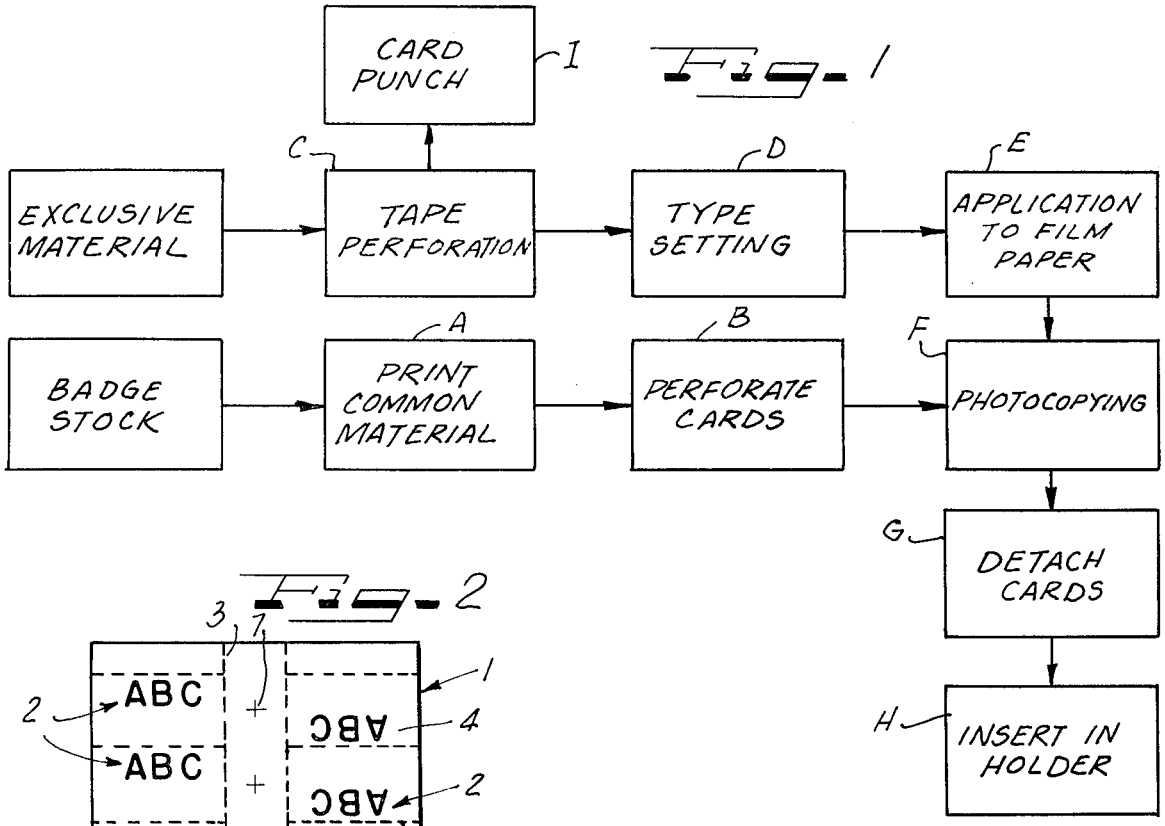
FIG. 1 is a flow diagram, in block form, illustrating sequential steps in the production of badges in accordance with the with the present invention.
Figure 2:
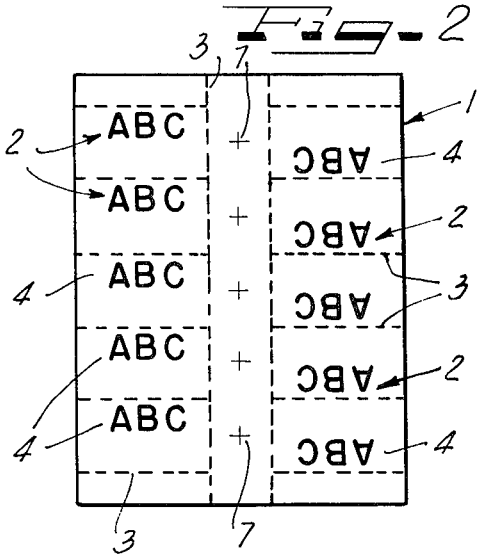
FIG. 2 illustrates a portion of a sheet of badge stock with the badges thereon having a common imprint.

Referring to FIG. 1, a sheet of stock, such as the sheet 1 of FIG. 2, from which a plurality of badges 2 are to be formed, is initially imprinted at a station A and in the same operation or at a subsequent station B may be perforated, for example, as illustrated in FIG. 2, by the broken lines 3. The material imprinted in such operation may comprise that which is common to all of the badges being produced, or to a number thereof, sufficiently large to make it advantageous to imprint the same as a group, for example the material 4 of FIG. 2. Any suitable printing mechanism may be employed for such purpose and likewise if the blanks are to be perforated, any suitable perforating equipment, either in combination with the printing mechanism or as an additional piece of equipment may be employed to achieve the desired results.

Figure 3:
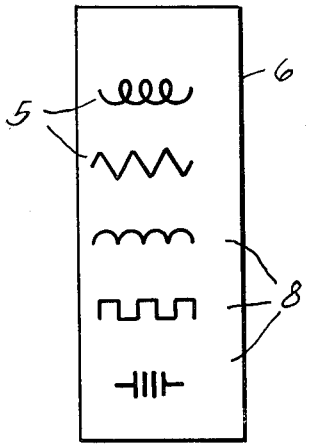
FIG. 3 illustrates a portion of a master copy sheet containing material exclusive to individual badges.

The material which each badge, for example material 5 illustrated in FIG. 3, is to carry exclusively is supplied to a suitable tape perforator C which provides a perforated tape containing the desired information and which may be supplied to a type setting mechanism D of any suitable type with tape control for effecting a type-setting representing such exclusive material. It will be appreciated that there are numrous tape perforating equipment available, as well as various types of type-setting machinery, for example, those known under the trademarks "COMPUGRAPHICS 4961" and "Varityper 748" are typical examples of equipment which may be employed for these operations. Following the type setting operation, making sure that the material exclusive to each individual badge blank is accurately oriented both vertically and horizontally with respect to the orientation of the individual badges and material thereon disposed on the sheet of badge stock, the set type is then employed, at Station F of FIG. 1, to form a master copy 6, schematically illustrated in FIG. 3, containing such exclusive material. Suitable paper, for example film paper, may be employed as the media upon which the exclusive material is received, and any suitable type of film paper or the like may be employed. One which has proven to be very efficient is that designated as "Spectamatic" film paper manufactured by Eastman Kodak Company. The master copy so formed is then suitably employed as original copy material on a duplicating machine i.e., a photocopying machine (Station F of FIG. 1) with the sheet of badge stock containing the respective badge blanks being utilized as the supply stock of the photocopying equipment.

One machine found to be particularly suitable for such copy work is that manufactured by Xerox Corporation, employing an electrostatic process.

Figure 4:
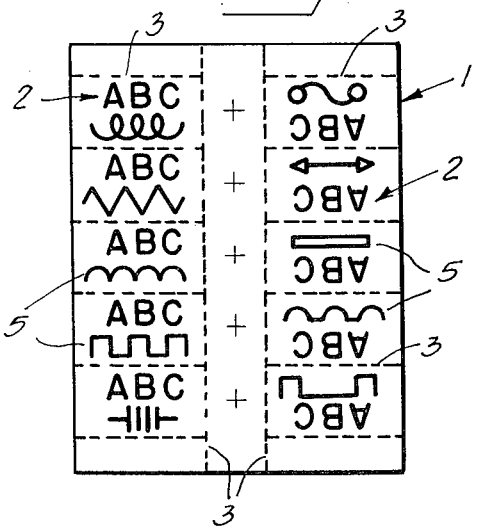
FIG. 4 is a portion of a sheet of badges following application of such exclusive material thereto.

In effecting the photocopying, the film paper carrying the exclusive material will have such material exclusive to the individual badges spaced identically with the badge spacing on the sheet of badge stock so that by proper orientation of the film paper in the copy window of the machine, it may be readily accurately aligned for proper reproduction. Preferably, the film paper, as used in the copying machine is in the form of a strip, of a width to contain a single column of the respective inserts to appear on each badge, with such film paper being cut in lengths to accommodate the same number of badges as appears in a column on the sheet of badge stock and if desired the direction of the columns may be reversed as illustrated in FIGS. 2 and 4. Registration may be facilitated by suitable cooperable registration marks 7 on the imprinted badge stock and the marks 8 on the respective film strips.

In most cases the size of the badge 2 will be such that two columns of badges, each column containing four or five badge blanks, may be obtained from a single sheet of badge stock which, of necessity, must be limited in size to that capable of being processed by a particular photocopy machine involved, for example 8½ × 14 inches.

While the limitations of the copying machine employed, of necessity imposes maximum dimensions of the sheet of badge stock employed, such a sheet is of adequate size to enable the production of from 8 to 10 badges per sheet of the type that will normally be involved. Likewise, the limitations on such machines as to thickness of stock which may be run through the machine imposes a further maximum limit with respect to the thickness of such sheet stock. It is believed that in most cases the stock may run from 0.0095 inch to 0.005 inch which will normally be of adequate thickness for the desired purposes.

The finished badge card 2 may then be detached, as indicated at G in FIG. 1, and subsequently inserted in a suitable plastic or other holder with adhesive or thin type fastening means, etc., as indicated at H in FIG. 1.

It will also be appreciated that by perforating the card prior to entering into the copying machine provides additional flexibility to the card stock enabling it to more readily conform to the circumference of the drum structures employed with such types of copying machines.

The paper tape following its usage in the method above described can then be readily employed for the production of computer cards and the like, as indicated at I in FIG. 1, whereby such cards contain the information originally on the tape, and following transfer to the cards such information is thereafter available for use in computers, etc. for a wide variety of purposes, for example, making labels, rosters or any other information that might be pertinent.

It will be appreciated from the above that I have provided a novel method in which a plurality of badges may be produced, each of which carries its own distinctive exclusive material in addition to material common to all of the badges, and eliminates difficulties associated with performing customary printing operations with respect to the exclusive material, thereby further eliminating considerable labor as well as effecting a considerable savings in time. The application of the exclusive material by means of a photocopying machine provides not only a simple method but one which may be readily performed, with the registration of the exclusive material with respect to the common material being readily performed without necessitating makeup changes, etc. that might otherwise be involved where a strict imprinting operation is employed.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A method of fabricating a plurality of individual badges such as name badges and the like, each bearing printed indicial material common to all of such plurality of badges, and each bearing specific printed indicial material exclusive to the respective individual badges, comprising the steps of forming a plurality of badge blanks by imprinting a sheet of badge stock, from which a plurality of badges are to be formed, with the indicial material common to all of such badges being disposed in predetermined orientation and spacing, forming a perforated tape strip containing the specific printed indicial material exclusive to the plurality of badges of such sheet, controlling the operation of a typesetting machine with said tape to effect a typesetting of such exclusive printed indicial material, while effecting an orientation and spacing of such material in correspondence to the orientation and spacing of the common material on said sheet of badge stock, reproducing from said type set material a master copy on a sheet of material, with the respective specific indicial material thereon operatively aligned both vertically and horizontally with the cooperable common indicial material of respective badge blanks on said sheet of badge stock, and electrostatically reproducing the indicial material on said master copy on said badge blanks, to provide a plurality of individualized badges which may be subsequently detached from said sheet for insertion in individual carrier means therefor.

2. A method according to claim 1 comprising in further combination the step of perforating all edges of the badges necessary to sever each badge from the sheet of badge stock.

3. A method according to claim 1 comprising in further combination the step of providing registration marks on both the imprinted sheet of badge stock and on the master copy for effecting accurate registration of the exclusive material on said sheet.

* * * * *